US010998616B2

(12) United States Patent
Mow et al.

(10) Patent No.: US 10,998,616 B2
(45) Date of Patent: May 4, 2021

(54) ELECTRONIC DEVICE WITH MILLIMETER WAVE ANTENNA ARRAYS

(71) Applicant: Apple Inc., Cupertino, CA (US)

(72) Inventors: Matthew A. Mow, Los Altos, CA (US); Basim H. Noori, San Jose, CA (US); Mattia Pascolini, San Francisco, CA (US); Xu Han, San Jose, CA (US); Victor C. Lee, Sunnyvale, CA (US); Ming-Ju Tsai, Cupertino, CA (US); Simone Paulotto, Redwood City, CA (US)

(73) Assignee: Apple Inc., Cupertino, CA (US)

( * ) Notice: Subject to any disclaimer, the term of this patent is extended or adjusted under 35 U.S.C. 154(b) by 200 days.

(21) Appl. No.: 16/272,932

(22) Filed: Feb. 11, 2019

(65) Prior Publication Data

US 2019/0173160 A1 Jun. 6, 2019

Related U.S. Application Data

(63) Continuation of application No. 15/275,183, filed on Sep. 23, 2016, now Pat. No. 10,205,224.

(51) Int. Cl.
*H01Q 1/24* (2006.01)
*H01Q 1/22* (2006.01)
(Continued)

(52) U.S. Cl.
CPC ..... *H01Q 1/243* (2013.01); *H01Q 1/22* (2013.01); *H01Q 1/242* (2013.01); *H01Q 1/48* (2013.01);
(Continued)

(58) Field of Classification Search
CPC ... H01Q 21/062; H01Q 21/065; H01Q 1/2283
See application file for complete search history.

(56) References Cited

U.S. PATENT DOCUMENTS 4,888,597 A 12/1989 Rebiez et al.
2010/0033393 A1 2/2010 Myszne et al.
(Continued)

FOREIGN PATENT DOCUMENTS

CN 102349073 A 2/2012
CN 103339796 A 10/2013
(Continued)

*Primary Examiner* — Ricardo I Magallanes
(74) *Attorney, Agent, or Firm* — Treyz Law Group, P.C.; Tianyi He

(57) ABSTRACT

An electronic device may be provided with wireless circuitry. The wireless circuitry may include one or more antennas. The antennas may include millimeter wave antenna arrays formed from arrays of patch antennas, dipole antennas or other millimeter wave antennas on millimeter wave antenna array substrates. Circuitry such as upconverter and downconverter circuitry may be mounted on the substrates. The upconverter and downconverter may be coupled to wireless communications circuitry such as a baseband processor circuit using an intermediate frequency signal path. The electronic device may have opposing front and rear faces. A display may cover the front face. A rear housing wall may cover the rear face. A metal midplate may be interposed between the display and rear housing wall. Millimeter wave antenna arrays may transmit and receive antenna signals through the rear housing wall.

19 Claims, 8 Drawing Sheets

(51) Int. Cl.

| | |
|---|---|
| ***H01Q 21/06*** | (2006.01) |
| ***H01Q 21/28*** | (2006.01) |
| ***H01Q 1/48*** | (2006.01) |
| ***H01Q 9/04*** | (2006.01) |

(52) U.S. Cl.
CPC ..... *H01Q 9/0421* (2013.01); *H01Q 21/062* (2013.01); *H01Q 21/065* (2013.01); *H01Q 21/28* (2013.01); *H01Q 1/2283* (2013.01)

(56) References Cited

U.S. PATENT DOCUMENTS

| | | | | |
|---|---|---|---|---|
| 2012/0235881 | A1 | 9/2012 | Pan et al. | |
| 2013/0278468 | A1 | 10/2013 | Yehezkely et al. | |
| 2015/0249485 | A1 | 9/2015 | Ouyang et al. | |
| 2016/0248169 | A1 * | 8/2016 | Mohammadian .... | H01Q 21/065 |
| 2017/0062953 | A1 | 3/2017 | Teshima et al. | |

FOREIGN PATENT DOCUMENTS

| | | | | |
|---|---|---|---|---|
| CN | 104332719 | A | 2/2015 | |
| CN | 204539638 | U | 8/2015 | |
| CN | 105811079 | A | 7/2016 | |
| EP | 3185361 | A1 * | 6/2017 | ..... H01Q 21/062 |
| JP | 2014123945 | A | 7/2014 | |
| WO | WO-2016063759 | A1 * | 4/2016 | ..... H01Q 13/08 |
| WO | WO-2017047396 | A1 * | 3/2017 | ..... H01Q 21/0025 |

* cited by examiner

ELECTRONIC DEVICE WITH MILLIMETER WAVE ANTENNA ARRAYS

This application is a continuation of U.S. patent application Ser. No. 15/275,183, filed on Sep. 23, 2016 which is hereby incorporated by reference herein in its entirety.

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave communications bands. Millimeter wave communications, which are sometimes referred to as extremely high frequency (EHF) communications, involve communications at frequencies of about 10-400 GHz. Operation at these frequencies may support high bandwidths, but may raise significant challenges. For example, it can be difficult to incorporate millimeter wave communications circuitry into electronic devices that include other types of communications circuitry and that include metal housing structures.

SUMMARY

An electronic device may be provided with wireless circuitry. The wireless circuitry may include one or more antennas. The antennas may include millimeter wave antenna arrays formed from arrays of millimeter wave antennas on millimeter wave antenna array substrates. The antennas may also include wireless local area network antennas, satellite navigation system antennas, cellular telephone antennas, and other antennas.

Circuitry such as upconverter and downconverter circuitry may be mounted on the substrate of a millimeter wave antenna array. The upconverter and downconverter circuitry may be coupled to wireless communications circuitry such as a baseband processor circuit using an intermediate frequency signal path.

The electronic device may have opposing front and rear faces. A display may cover the front face. A rear housing wall may cover the rear face. A metal midplate may be interposed between the display and rear housing wall. The rear housing wall may be formed from a dielectric such as glass (e.g., a layer of glass), plastic, etc. Millimeter wave antenna arrays may transmit and receive antenna signals through the rear housing wall.

A millimeter wave antenna array may be interposed between the midplate and the rear housing wall, may be mounted to a printed circuit that is interposed between the midplate and the display so that the substrate of the millimeter wave antenna array protrudes through an opening in the midplate, and/or may be located between the midplate and the display so that millimeter wave antenna signals may be transmitted and received through an opening in the midplate and through the rear housing wall.

DETAILED DESCRIPTION

Figure 1:
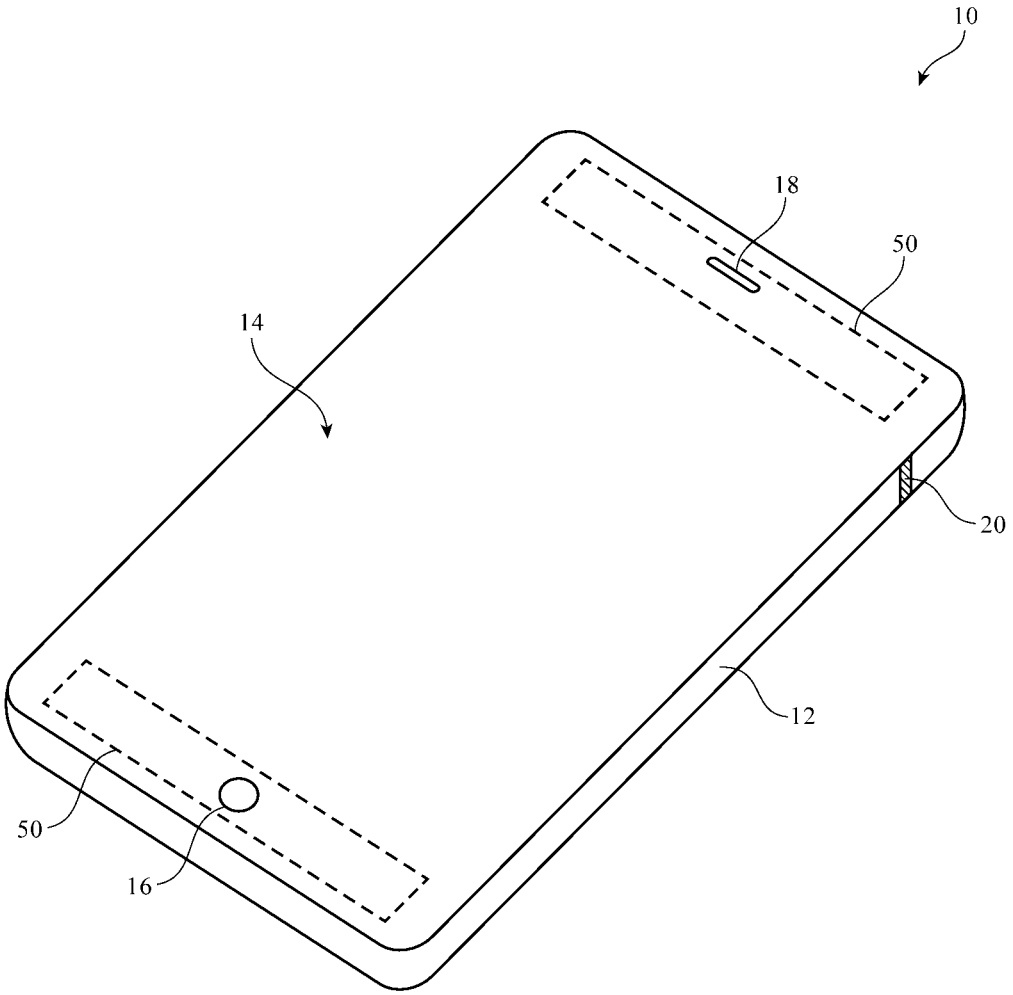
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include cellular telephone antennas, wireless local area network antennas (e.g., WiFi® antennas at 2.4 GHz and 5 GHz and other suitable wireless local area network antennas), satellite navigation system signals, and near-field communications antennas. The antennas may also include antennas for handling millimeter wave communications. For example, the antennas may include millimeter wave phased antenna arrays. Millimeter wave communications, which are sometimes referred to as extremely high frequency (EHF) communications, involve signals at 60 GHz or other frequencies between about 10 GHz and 400 GHz.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. For example, device 10 may have opposing front and rear faces and display 14 may be mounted in housing 12 so that display 14 covers the front face of device 10 as shown in FIG. 1. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). If desired, different portions of housing 12 may be formed from different materials. For example, housing sidewalls may be formed from metal and some or all of the rear wall of housing 12 may be formed from a dielectric such as plastic, glass, ceramic, sapphire, etc. Dielectric rear housing wall materials such as these may, if desired, by laminated with metal plates and/or other metal structures to enhance the strength of the rear housing wall (as an example).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of pixels formed from liquid crystal display (LCD) components, an array of electrophoretic pixels, an array of plasma pixels, an array of organic light-emitting diode pixels, an array of electrowetting pixels, or pixels based on other display technologies.

Display 14 may be protected using a display cover layer such as a layer of transparent glass, clear plastic, sapphire, or other transparent dielectric. Openings may be formed in the display cover layer. For example, an opening may be formed in the display cover layer to accommodate a button such as button 16. Buttons such as button 16 may also be formed from capacitive touch sensors, light-based touch sensors, or other structures that can operate through the display cover layer without forming an opening.

If desired, an opening may be formed in the display cover layer to accommodate a port such as speaker port 18. Openings may be formed in housing 12 to form communications ports (e.g., an audio jack port, a digital data port, etc.). Openings in housing 12 may also be formed for audio components such as a speaker and/or a microphone. Dielectric-filled openings 20 such as plastic-filled openings may be formed in metal portions of housing 12 such as in metal sidewall structures (e.g., to serve as antenna windows and/or to serve as gaps that separate portions of antennas from each other).

Antennas may be mounted in housing 12. If desired, some of the antennas (e.g., antenna arrays that may implement beam steering, etc.) may be mounted under dielectric portions of device 10 (e.g., portions of the display cover layer, portions of a plastic antenna window in a metal housing sidewall portion of housing 12, etc.). With one illustrative configuration, some or all of rear face of device 10 may be formed from a dielectric. For example, the rear wall of housing 12 may be formed from glass plastic, ceramic, other dielectric. In this type of arrangement, antennas may be mounted within the interior of device 10 in a location that allows the antennas to transmit and receive antenna signals through the rear wall of device 10 (and, if desired, through optional dielectric sidewall portions in housing 12). Antennas may also be formed from metal sidewall structures in housing 12 and may be located in peripheral portions of device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing, along the peripheral edges of housing 12, on the rear of housing 12, under the display cover layer that is used in covering and protecting display 14 on the front of device 10 (e.g., a glass cover layer, a sapphire cover layer, a plastic cover layer, other dielectric cover layer structures, etc.), under a dielectric window on a rear face of housing 12 or the edge of housing 12, under a dielectric rear wall of housing 12, or elsewhere in device 10. As an example, antennas may be mounted at one or both ends 50 of device 10 (e.g., along the upper and lower edges of housing 12, at the corners of housing 12, etc.).

Figure 2:
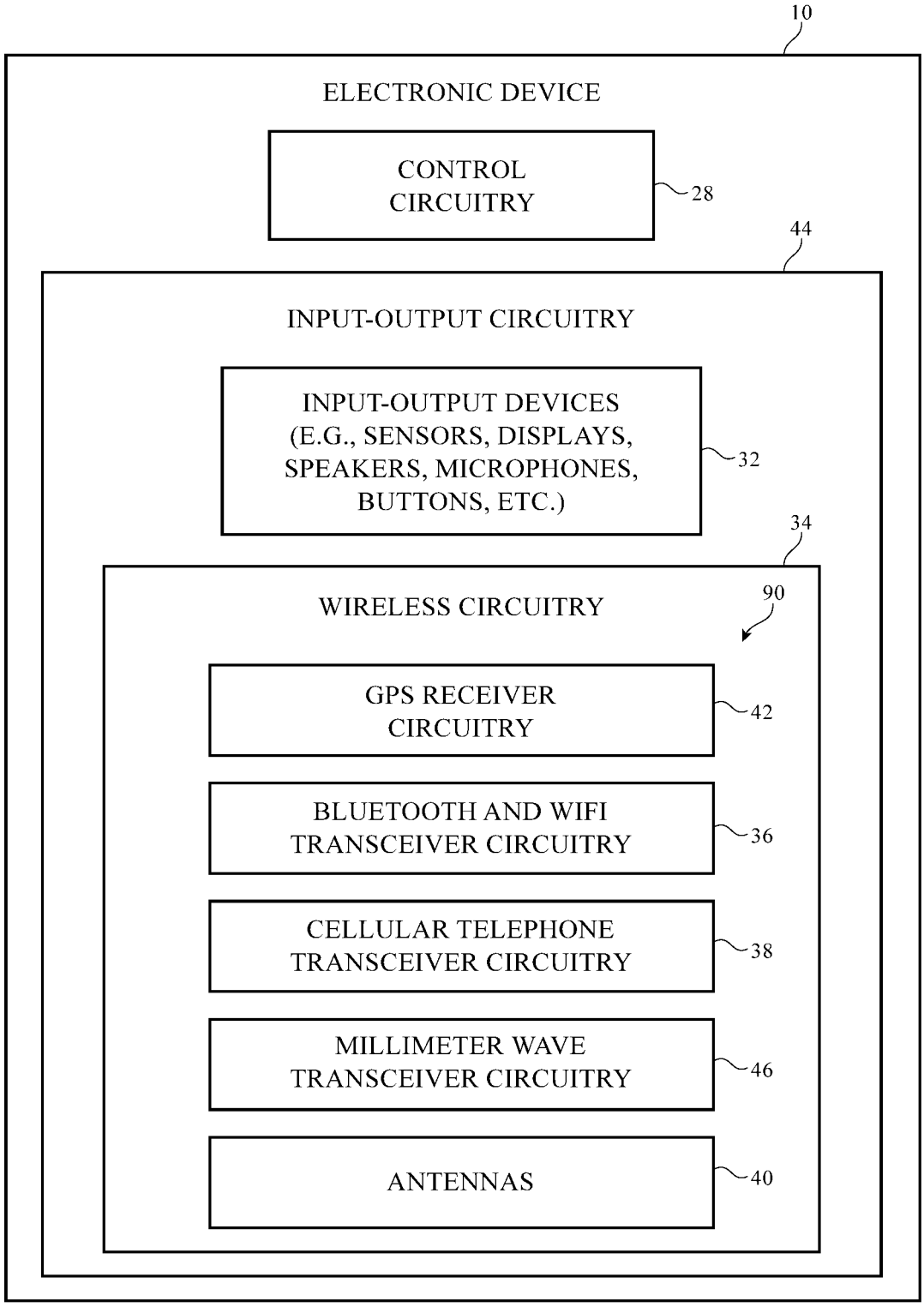
FIG. 2 is a schematic diagram of an illustrative electronic device with wireless communications circuitry in accordance with an embodiment.

A schematic diagram of illustrative components that may be used in device 10 is shown in FIG. 2. As shown in FIG. 2, device 10 may include storage and processing circuitry such as control circuitry 28. Control circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 28 may be used to control the operation of device 10. This processing circuitry may be based on one or more microprocessors, microcontrollers, digital signal processors, baseband processor integrated circuits, application specific integrated circuits, etc.

Control circuitry 28 may be used to run software on device 10, such as internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, satellite navigation system protocols, millimeter wave communications protocols, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, 42, and 46.

Transceiver circuitry 36 may be wireless local area network transceiver circuitry. Transceiver circuitry 36 may handle 2.4 GHz and 5 GHz bands for WiFi® (IEEE 802.11) communications and may handle the 2.4 GHz Bluetooth® communications band.

Circuitry 34 may use cellular telephone transceiver circuitry 38 for handling wireless communications in frequency ranges such as a communications band from 700 to 960 MHz, a band from 1710 to 2170 MHz, a band from 2300 to 2700 MHz, other bands between 700 and 2700 MHz, higher bands such as LTE bands 42 and 43 (3.4-3.6 GHz), or other cellular telephone communications bands. Circuitry 38 may handle voice data and non-voice data.

Millimeter wave transceiver circuitry 46 (sometimes referred to as extremely high frequency transceiver circuitry) may support communications at extremely high frequencies (e.g., millimeter wave frequencies such as extremely high frequencies of 10 GHz to 400 GHz or other millimeter wave frequencies). For example, circuitry 46 may support IEEE 802.11ad communications at 60 GHz. Circuitry 46 may be formed from one or more integrated circuits (e.g., multiple integrated circuits mounted on a common printed circuit in a system-in-package device, one or more integrated circuits mounted on different substrates, etc.).

Wireless communications circuitry 34 may include satellite navigation system circuitry such as Global Positioning System (GPS) receiver circuitry 42 for receiving GPS signals at 1575 MHz or for handling other satellite positioning data (e.g., GLONASS signals at 1609 MHz). Satellite navigation system signals for receiver 42 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 46 may convey signals over these short distances that travel between transmitter and receiver over a line-of-sight path. To enhance signal reception for millimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can include phased antenna arrays for handling millimeter wave communications.

In configurations for device 10 in which housing 12 has portions formed from metal, openings may be formed in the metal portions to accommodate antennas 40. For example, openings in a metal housing wall may be used in forming splits (gaps) between resonating element structures and ground structures in cellular telephone antennas. These openings may be filled with a dielectric such as plastic. As shown in FIG. 1, for example, a portion of plastic-filled opening 20 may run up one or more of the sidewalls of housing 12.

Figure 3:
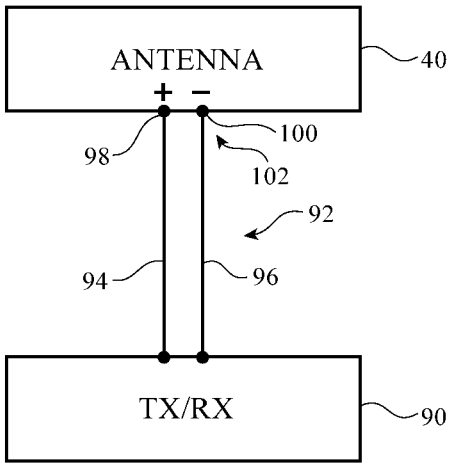
FIG. 3 is a diagram of an illustrative transceiver circuit and antenna in accordance with an embodiment.

A schematic diagram of a millimeter wave antenna or other antenna 40 coupled to transceiver circuitry 90 (e.g., millimeter wave transceiver circuitry 46 and/or other transceiver circuitry 90) is shown in FIG. 3. As shown in FIG. 3, radio-frequency transceiver circuitry 90 may be coupled to antenna feed 102 of antenna 40 using transmission line 92. Antenna feed 102 may include a positive antenna feed terminal such as positive antenna feed terminal 98 and may have a ground antenna feed terminal such as ground antenna feed terminal 100. Transmission line 92 may be formed form metal traces on a printed circuit or other conductive structures and may have a positive transmission line signal path such as path 94 that is coupled to terminal 98 and a ground transmission line signal path such as path 96 that is coupled to terminal 100. Transmission line paths such as path 92 may be used to route antenna signals within device 10. For example, transmission line paths may be used to couple antenna structures such as one or more antennas in an array of antennas to transceiver circuitry 90. Transmission lines in device 10 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within transmission line 92 and/or circuits such as these may be incorporated into antenna 40 (e.g., to support antenna tuning, to support operation in desired frequency bands, etc.).

If desired, signals for millimeter wave antennas may be distributed within device 10 using intermediate frequencies (e.g., frequencies of about 5-15 GHz rather than 60 Hz). The intermediate frequency signals may, for example, be distributed from a baseband processor or other wireless communications circuit located near the middle of device 10 to one or more arrays of millimeter wave antennas at the corners of device 10. At each corner, upconverter and downconverter circuitry may be coupled to the intermediate frequency path. The upconverter circuitry may convert received intermediate frequency signals from the baseband processor to millimeter wave signals (e.g., signals at 60 GHz) for transmission by a millimeter wave antenna array. The downconverter circuitry may downconvert millimeter wave antenna signals from the millimeter wave antenna array to intermediate frequency signals that are then conveyed to the baseband processor over the intermediate frequency path.

Device 10 may contain multiple antennas 40. The antennas may be used together or one of the antennas may be switched into use while other antenna(s) are switched out of use. If desired, control circuitry 28 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may include antenna arrays (e.g., phased antenna arrays to implement beam steering functions). For example, the antennas that are used in handling millimeter wave signals for extremely high frequency wireless transceiver circuits 46 may be implemented as phased antenna arrays. The radiating elements in a phased antenna array for supporting millimeter wave communications may be patch antennas, dipole antennas, dipole antennas with directors and reflectors in addition to dipole antenna resonating elements (sometimes referred to as Yagi antennas or beam antennas), or other suitable antenna elements. Transceiver circuitry can be integrated with the phased antenna arrays to form integrated phased antenna array and transceiver circuit modules.

Figure 4:
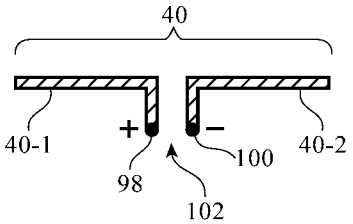
FIG. 4 is a diagram of an illustrative dipole antenna in accordance with an embodiment.

An illustrative dipole antenna is shown in FIG. 4. As shown in FIG. 4, dipole antenna 40 may have first and second arms such as arms 40-1 and 40-2 and may be fed at antenna feed 102. If desired, a dipole antenna such as dipole antenna 40 of FIG. 4 may be incorporated into a Yagi antenna (e.g., by incorporating a reflector and directors into dipole antenna 40 of FIG. 4).

Figure 5:
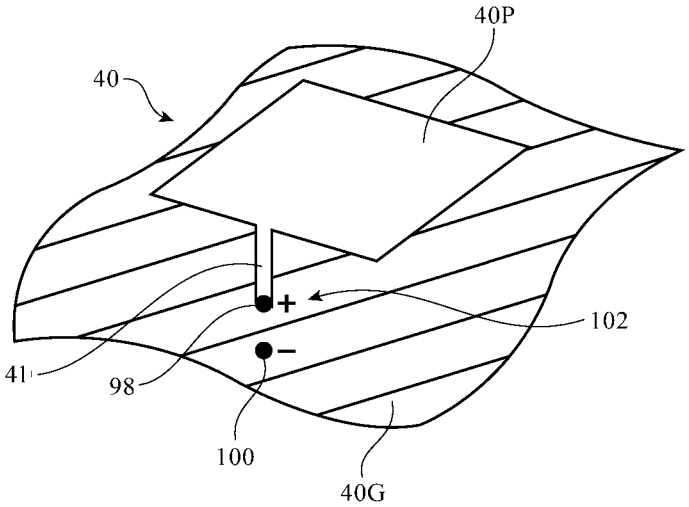
FIG. 5 is a perspective view of an illustrative patch antenna that may be used in an electronic device in accordance with an embodiment.

An illustrative patch antenna is shown in FIG. 5. As shown in FIG. 5, patch antenna 40 may have a patch antenna resonating element 40P that is separated from and parallel to a ground plane such as antenna ground plane 40G. Arm 41 may be coupled between patch antenna resonating element 40P and positive antenna feed terminal 98 of antenna feed 102. Ground antenna feed terminal 100 of feed 102 may be coupled to ground plane 40G.

Antennas of the types shown in FIGS. 4 and 5 and/or other antennas 40 may be used in forming millimeter wave antennas. The examples of FIGS. 4 and 5 are merely illustrative.

Figure 6:
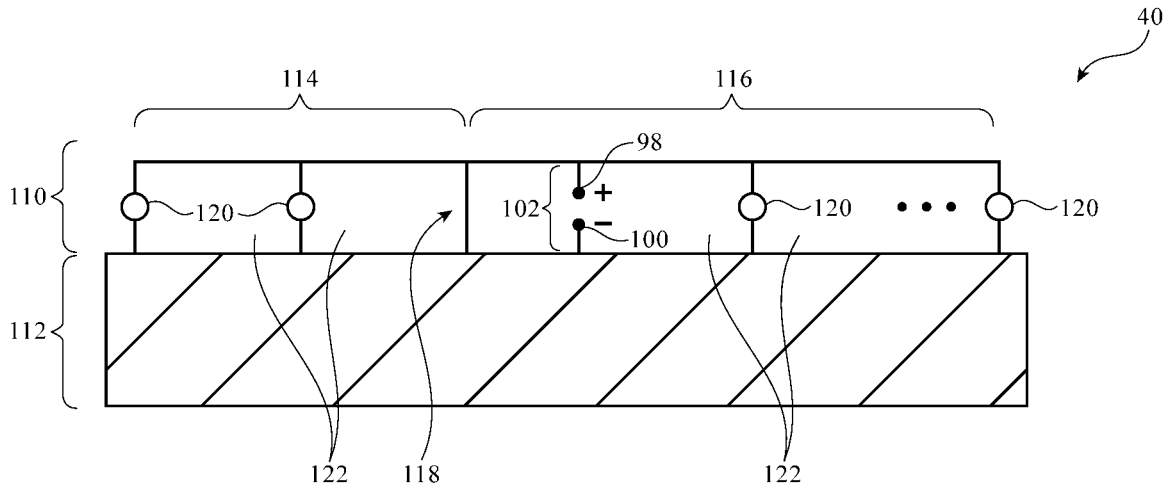
FIG. 6 is a diagram of an illustrative antenna such as a cellular telephone antenna that includes an inverted-F antenna resonating element in accordance with an embodiment.

FIG. 6 is a diagram of an illustrative antenna 40 based on an inverted-F antenna resonating element. Antenna 40 of FIG. 6 may be, for example, an inverted-F antenna or a hybrid inverted-F slot antenna. Antenna 40 of FIG. 6 may be used in forming cellular telephone antennas, wireless local network antennas, satellite navigation system antennas, and/or other antennas in device 10.

As shown in FIG. 6, antenna 40 may include an antenna resonating element such as antenna resonating element 110 and an antenna ground such as antenna ground 112. Antenna resonating element 110 may have one or more branches such as low-frequency arm 116 and high frequency arm 114. Arms of different lengths in element 110 may provide element 110 with the ability to resonate at multiple frequency bands of interest. Return path 118 (sometimes referred to as a short circuit path) may be coupled between resonating element 110 and ground 112. Antenna feed 102 may include positive antenna feed terminal 98 and ground antenna feed terminal 100 and may be coupled between element 110 and ground 112 in parallel with return path 118. One or more components 120 (switches, tunable circuits such as tunable capacitors, tunable inductors, etc.) may be coupled between antenna ground 112 and resonating element arms 114 and 116. Components 120 may be adjusted to tune antenna 40.

If desired, antenna resonating element arms 114 and 116 may be separated from ground 112 by a dielectric gap that serves as a slot antenna resonating element (e.g., slot 122 of FIG. 6). In this type of arrangement, antenna 40 may be a hybrid inverted-F slot antenna and may receive resonant contributions from both the inverted-F antenna resonating element arm(s) 114 and 116 and from the slot antenna formed from slot 122. In other illustrative configurations, slot 122 does not contribute any slot resonances to antenna 40 (e.g., antenna 40 may operate as an inverted-F antenna). Antennas such as antenna 40 of FIG. 6 (e.g., inverted-F antennas, slot antennas, hybrid inverted-F slot antennas, etc.) and/or other types of antenna (e.g., patch antennas, loop antennas, etc.) may be used in supporting cellular telephone communications, wireless local area network communications (e.g., communications at 2.4 and 5 GHz, etc.) and/or other wireless communications.

Antennas 40 may be formed from sheet metal parts (e.g., strips of sheet metal embedded in molded plastic or attached to dielectric supports using adhesive, etc.), may be formed from wires, may be formed from portions of conductive housing structures (e.g., metal walls in housing 12), and/or may be formed from conductive structures such as metal traces on a printed circuit or other substrate. Printed circuits in device 10 may be rigid printed circuit boards formed from rigid printed circuit board substrate material (e.g., fiberglass-filled epoxy) and/or may be flexible printed circuit boards (e.g., printed circuits formed from sheets of polyimide or other flexible polymer layers). In some configurations, antenna substrates may be formed from other dielectrics (e.g., ceramics, glass, etc.).

Figure 7:
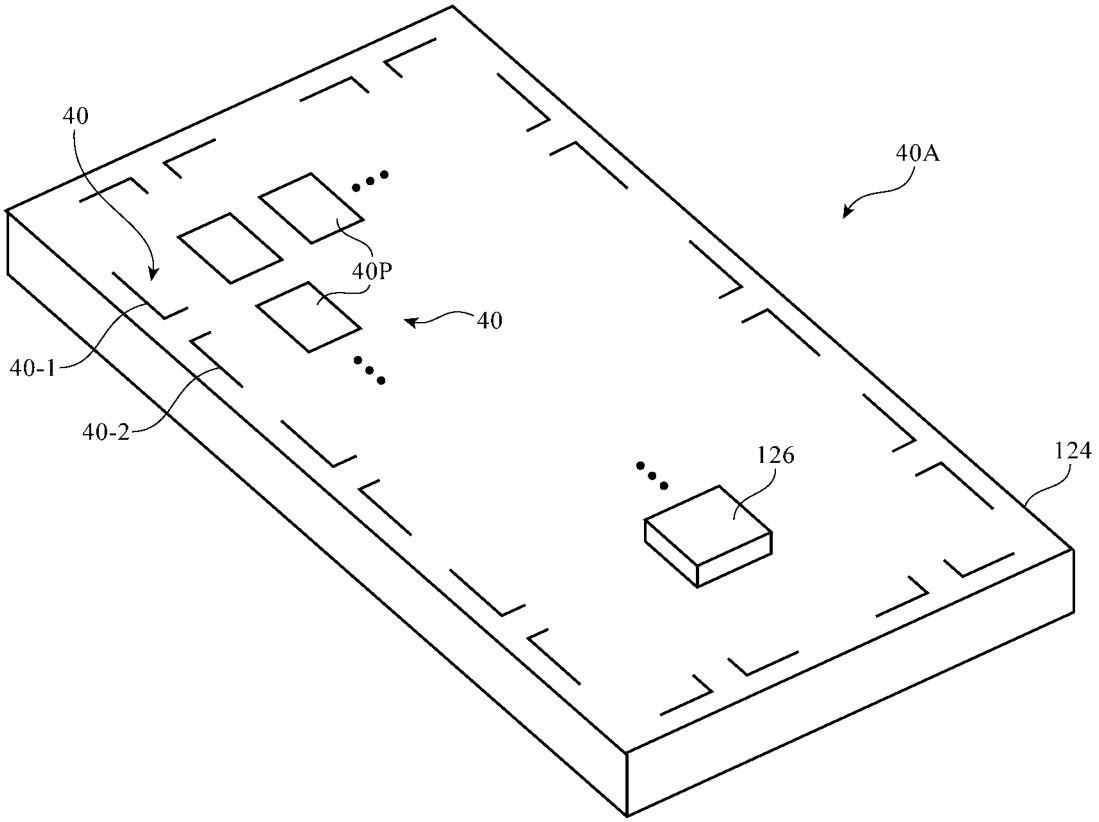
FIG. 7 is a perspective view of an illustrative array of millimeter wave antennas on a millimeter wave antenna array substrate in accordance with an embodiment.

FIG. 7 is a perspective view of an illustrative millimeter wave antenna array 40A formed from antenna resonating elements on millimeter wave antenna array substrate 124. Array 40A may include an array of millimeter wave antennas such as patch antennas 40 formed from patch antenna resonating elements 40P and dipole antennas 40 formed from arms 40-1 and 40-2. With one illustrative configuration, dipole antennas 40 may be formed around the periphery of substrate 124 and patch antennas 40 may form an array on the central surface of substrate 124. There may be any suitable number of millimeter wave antennas 40 in array 40A. For example, there may be 10-40, 32, more than 5, more than 10, more than 20, more than 30, fewer than 50, or other suitable number of millimeter wave antennas (patch antennas and/or dipole antennas, etc.). Substrate 124 may be formed from one or more layers of dielectric (polymer, ceramic, etc.) and may include patterned metal traces for forming millimeter wave antennas and signal paths. The signals paths may couple the millimeter wave antennas to circuitry such as one or more electrical devices 126 mounted on substrate 124. Device(s) 126 may include one or more integrated circuits, discrete components, upconverter circuitry, downconverter circuitry, (e.g., upconverter and downconverter circuitry that forms part of a transceiver), circuitry for adjusting signal amplitude and/or phase to perform beam steering, and/or other circuitry for operating antenna array 40A.

Figure 8:
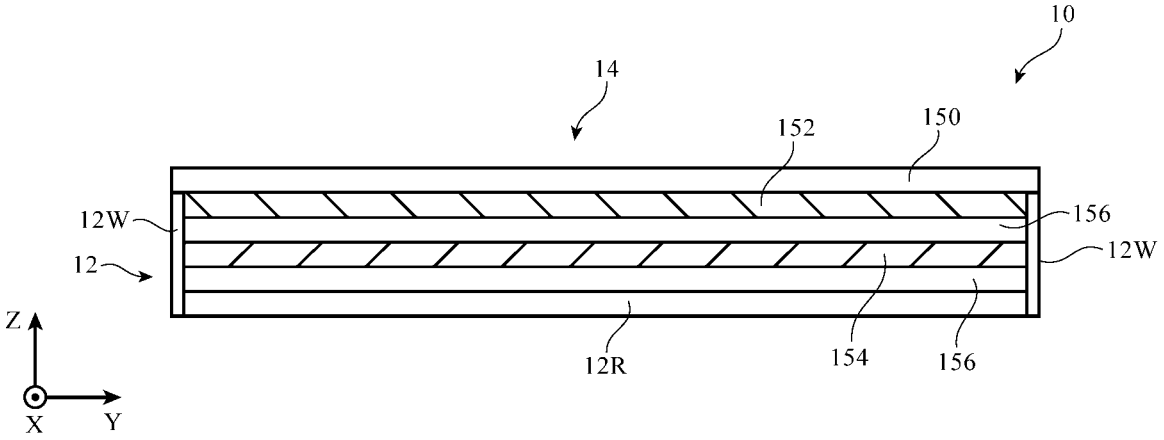
FIG. 8 is a cross-sectional side view of an illustrative electronic device in accordance with an embodiment.

A cross-sectional side view of device 10 in an illustrative configuration in which device 10 includes a display covering the front face of device 10 and has a rear housing wall on the rear face of device 10 through which antennas may operate is shown in FIG. 8. As shown in FIG. 8, device 10 may have housing sidewalls such as housing sidewalls 12W. Housing sidewalls 12W may have flat shapes that extend vertically (along dimension Z) or may have curved cross-sectional shapes that extend upwardly from rear wall 12R toward display 14. Housing sidewalls 12W may be formed from metal or other suitable material. Display 14 may include a transparent display cover layer such as display cover layer 150. Display cover layer 150 may be formed from transparent glass, crystalline material such as sapphire, clear plastic, or other suitable material. Display cover layer 150 may overlap display module (display) 152. Display 152 may be an organic light-emitting diode display, a liquid crystal display, or other suitable display and may overlap some, nearly all, or all of the front face of device 10 (e.g., display 152 may cover 80% or more of the front of device 10, 90% or more of the front of device 10, 95% or more of the front of device 10, or 99% or more of the front of device 10). Display 152 may be attached to the underside of display cover layer 150 using adhesive or may be separated from display cover layer 150 by an air gap. If desired, a touch sensor layer (e.g., a layer of polymer covered on one side or two opposing sides with capacitive touch sensor electrodes) may be interposed between display 152 and display cover layer 150. Touch sensor electrodes may also be formed within display 152.

Device 10 may have structural support members such as internal housing frame structures and/or other structures that help ensure that device 10 is sufficiently robust. Device 10 may, for example, have one or more internal sheet metal parts (e.g., stamped sheet metal parts) such as midplate 154. Midplate 154 may, for example, be coupled to metal housing sidewalls 12W by welds. Midplate 154 may be interposed between display 152 and rear housing wall 12R. Air gaps adjacent to midplate 154 such as air gaps 156 may be filled with batteries, integrated circuits, printed circuit boards, and/or other device components (see, e.g., control circuitry 28 and input-output circuitry 44 of FIG. 2).

Rear housing wall 12R may be formed from any suitable material. With one illustrative arrangement, some, nearly all, or all of rear housing wall 12R (e.g., the outer layer of housing wall 12R) may be formed from a dielectric such as glass, plastic, sapphire or other crystalline dielectric, etc. An optional inner housing wall portion for rear housing wall 12R may have portions formed from different materials (e.g., different dielectric materials, metal, etc.). Dielectric material for rear housing wall 12R may, for example, cover 80% or more of the rear of device 10, 90% or more of the rear of device 10, 95% or more of the rear of device 10, or 99% or more of the rear of device 10). With this type of arrangement, the outer surface of the rear face of device 10 may be covered with glass or plastic.

Due to the presence of dielectric in rear housing wall 12R, antennas 40 may transmit and receive antenna signals through at least this portion of wall 12R. For example, antennas 40 may transmit and/or receive cellular telephone signals, wireless local area network signals, satellite navigation system signals, near-field communications signals, and millimeter wave signals and/or other antenna signals through glass or plastic portions of wall 12R.

Figure 9:
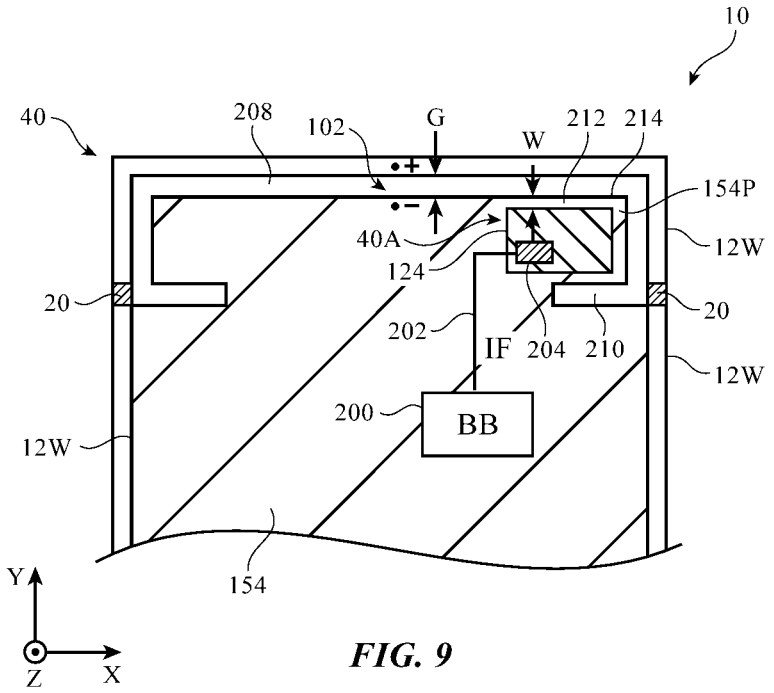
FIGS. 9 and 10 are top interior views of illustrative electronic devices with antennas in accordance with embodiments.
Figure 10:
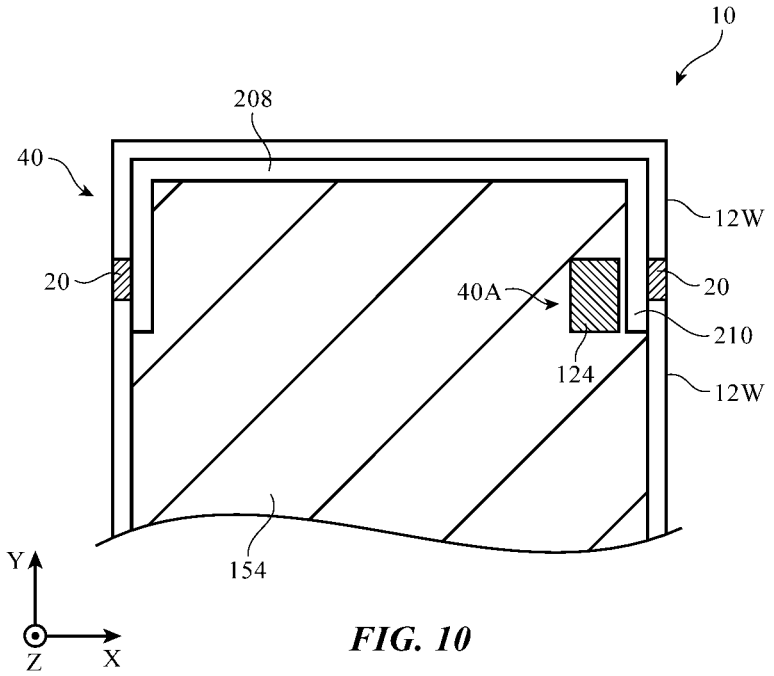

FIGS. 9 and 10 are top interior views of an illustrative end portion (at an end 50) of device 10. As shown in FIG. 9, metal housing sidewall 12W may have gaps 20 that are filled with plastic or other dielectric. The segment of metal housing sidewall 12W that extends between gaps 20 along the peripheral edge of device 10 may form an inverted-F antenna resonating element (see, e.g., arms 114 and 116 of FIG. 6) and may be fed using an antenna feed such as antenna feed 102 that extend between the inverted-F antenna resonating element and an antenna ground. The antenna ground may be formed from printed circuit board ground traces, internal metal structures in device 10, and/or ground plane structures such as metal midplate member 154. Gap 208 may be filled with air, plastic, and/or other dielectric. Protruding portion 154P of midplate 154 may lie between the main portion of gap 208 and end 210 of gap 208, which may extend between midplate portion 154P and the rest of midplate 154.

Millimeter wave antenna array 40A may be mounted on protruding portion 154P. In the example of FIG. 9, antenna array 40A is mounted in the upper right corner of device 10. This is merely illustrative. Antenna arrays 40A may be mounted in some or all of the four corners of device 10 and/or elsewhere in device 10.

Upconverter and downconverter circuitry 204 and other circuitry (see, e.g., circuitry 126 of FIG. 7) may be coupled to baseband processor 200 via intermediate frequency (IF) path 202. Antenna array 40A may include an array of millimeter wave antenna elements such as patch elements and/or dipoles, etc. (see, e.g., antennas 40 of FIG. 7). Substrate 124 of antenna array 40A may have an edge that is aligned with edge 214 of midplate 154 or may be recessed by a distance W (e.g., a distance less than 1 mm, less than 0.5 mm, more than 0.1 mm, etc.) from edge 214. Gap 208 may have a width G of 0.1-4 mm, more than 0.3 mm, more than 0.6 mm, more than 0.9 mm, less than 2.4 mm, less than 2.0 mm, less than 1.6 mm, less than 1.2 mm, or less than 0.8 mm.

In the configuration of FIG. 9, the ends of slot 208 such as slot (gap) end portion 210 extend inwardly from sidewalls 12W (parallel to the X dimension) and may separate portions of midplate 154 such as midplate protrusion 154P and millimeter wave antenna 40A from more central portions of midplate 154. FIG. 10 shows an illustrative configuration for device 10 in which the ends 210 of slot 208 do not extend inwardly from sidewall 12W. In this arrangement, millimeter wave antenna array 40A may be located adjacent to slot end 210, so that slot end 210 separates array 40A from wall 12W. Other locations for antenna 40A may be used, if desired. The configurations of device 10 that are shown in FIGS. 9 and 10 are merely illustrative.

Figure 11:
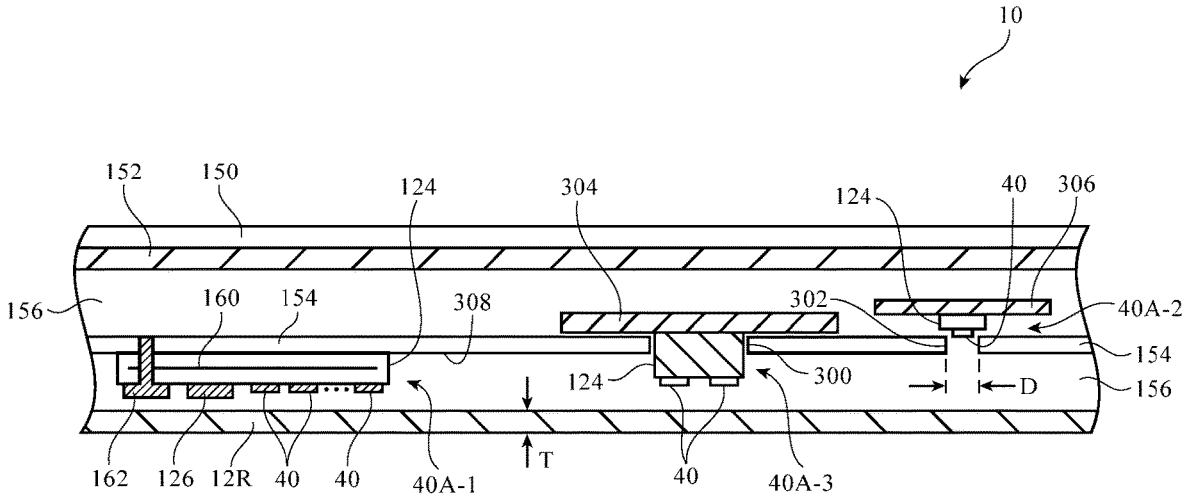
FIG. 11 is a cross-sectional side view of an illustrative electronic device with antennas in accordance with an embodiment.

As shown in the illustrative cross-sectional side view of device 10 of FIG. 11, millimeter wave antenna arrays such as array 40A of FIG. 7 may be mounted below midplate 154

(see, e.g., illustrative array 40A-1), may be mounted above midplate 154 (see, e.g., illustrative array 40A-2), or may be mounted so that substrate 124 protrudes through an opening in midplate 154 (see, e.g., illustrative antenna array 40A-3).

Substrates 124 may include ground plane traces such as ground plane trace 160 of array 40A-1. Conductive paths may short ground plane trace 160 to metal midplate 154. For example, one or more metal screws or other fasteners such as screw 162 may be used to electrically couple ground plane trace 160 to midplate 154 while mounting substrate 124 of array 40A-1 to rear surface 308 of midplate 154. Components such as circuit 126 may be mounted to substrate 124 and may face the inner surface of rear housing wall 12R. Rear housing wall 12R may be formed from dielectric (e.g., glass, sapphire, or other material of thickness T between 0.1 and 5 mm, between 0.4 and 1.2 mm, between 0.5 and 0.9 mm, less than 1 mm, etc.) and/or other layers of material (e.g., portions of wall 12R may be supported by a layer of sheet metal in regions that do not block antenna signals, etc.). If desired, substrate 124 may be coupled to a printed circuit board (e.g., a printed circuit interposed between midplate 154 and substrate 124. The configuration of FIG. 11 is illustrative.

Illustrative millimeter wave antenna arrays such as antenna array 40A-2 and antenna array 40A-3 may be mounted on substrates such as printed circuits 306 and 304, respectively. Midplate 154 may have openings such as openings 302 and 300. Antenna array 40A-2 may be positioned between display 152 and midplate 154 so that array 40A-2 and the antennas 40 on array 40A-2 may operate through opening 302. Opening 302 may have a diameter (lateral size) D of about 0.5-2 mm, more than 0.2 mm, more than 0.8 mm, more than 1.4 mm, more than 1.8 mm, less than 3 mm, less than 2.6 mm, less than 2.2 mm, etc. that is sufficiently large to allow antennas 40 to transmit and/or receive millimeter wave antenna signals through opening 302 (and through overlapping portions of rear wall 12R). Opening 300 in midplate 154 may have a size that accommodates substrate 124 of antenna array 40A-3. In particular, opening 300 may be sufficiently large to allow at least a portion of substrate 124 to protrude up and into (and, if desired, through) opening 300 so that antennas 40 of array 40A-3 may transmit and receive signals through the overlapping portion of rear wall 12R.

The foregoing is merely illustrative and various modifications can be made to the described embodiments. The foregoing embodiments may be implemented individually or in any combination.

What is claimed is:

1. An antenna array, comprising:

a substrate having a central portion and a periphery around the central portion;

a plurality of dipole antennas formed around the periphery of the substrate;

a plurality of patch antennas formed in the central portion of the substrate;

an electrical device configured to control the plurality of dipole antennas and the plurality of patch antennas, the electrical device being disposed in the central portion of the substrate between a portion of the plurality of dipole antennas and a portion of the plurality of patch antennas; and millimeter wave transceiver circuitry configured to transmit and receive signals at a frequency between 10 GHz and 400 GHz using the plurality of dipole antennas and the plurality of patch antennas.

2. The antenna array defined in claim 1, wherein each dipole antenna of the plurality of dipole antennas comprises first and second arms.

3. The antenna array defined in claim 1, wherein each patch antenna comprises a respective patch antenna resonating element.

4. The antenna array defined in claim 1, wherein the plurality of dipole antennas and the plurality of patch antennas are formed from patterned metal traces on the substrate.

5. The antenna array defined in claim 4, further comprising:

signal paths formed from additional patterned metal traces on the substrate.

6. The antenna array defined in claim 5, wherein the electrical device comprises upconverter circuitry and downconverter circuitry, and the signal paths couple the plurality of dipole antennas and the plurality of patch antennas to the electrical device.

7. The antenna array defined in claim 5, wherein the electrical device implements a portion of the millimeter wave transceiver circuitry, and the signal paths couple the plurality of dipole antennas and the plurality of patch antennas to the electrical device.

8. The antenna array defined in claim 5, wherein the electrical device comprises beam steering circuitry, and the signal paths couple the plurality of dipole antennas and the plurality of patch antennas to the electrical device.

9. The antenna array defined in claim 5, wherein the signal paths couple the plurality of dipole antennas and the plurality of patch antennas to the millimeter wave transceiver circuitry.

10. An antenna array, comprising:

a substrate having first and second opposing surfaces;

a plurality of millimeter wave patch antennas formed on the substrate at the first surface;

a plurality of millimeter wave dipole antennas formed on the substrate, wherein the plurality of millimeter wave dipole antennas is formed around a periphery of the substrate and surrounds the plurality of millimeter wave patch antennas; and an integrated circuit mounted on the first surface of the substrate, wherein the integrated circuit comprises transceiver circuitry configured to convey millimeter wave signals using the plurality of millimeter wave patch antennas and the plurality of millimeter wave dipole antennas.

11. The antenna array defined in claim 10, wherein each of the plurality of millimeter wave patch antennas comprises a patch antenna resonating element that is separated from and parallel to a ground plane.

12. The antenna array defined in claim 11, wherein each of the plurality of millimeter wave dipole antennas comprises a first arm that is coupled to a positive antenna feed terminal and a second arm that is coupled to a ground antenna feed terminal.

13. The antenna array defined in claim 10, wherein the millimeter wave signals comprise signals at 60 GHz.

14. The antenna array defined in claim 10, wherein the millimeter wave signals comprise signals between 10 GHz and 400 GHz.

15. An antenna array comprising:

a substrate;

an array of millimeter wave antennas disposed on a surface of the substrate, wherein the millimeter wave antenna array is configured to transmit and receive millimeter wave antenna signals, the array of millimeter wave antennas includes a plurality of dipole antennas formed from first and second arms and a plurality of patch antennas formed from patch antenna resonating elements, the plurality of dipole antennas are formed around a periphery of the substrate, and the plurality of patch antennas are formed in a center portion of the substrate and surrounded by the plurality of dipole antennas;

an electrical device disposed on the surface of the substrate, in the center portion of the substrate, and surrounded by the plurality of dipole antennas; and a signal path that couples the electrical device to the array of millimeter wave antennas.

16. The antenna array defined in claim 15, further comprising:

millimeter wave transceiver circuitry configured to transmit and receive signals at a frequency between 10 GHz and 400 GHz using the plurality of dipole antennas and the plurality of patch antennas.

17. The antenna array defined in claim 15, wherein the plurality of dipole antennas and the plurality of patch antennas are formed from patterned metal traces on the substrate.

18. The antenna array defined in claim 15, wherein the electrical device comprises a device selected from the group consisting of: an integrated circuit, a discrete component, upconverter circuitry, downconverter circuitry, and beam steering circuitry.

19. The antenna array defined in claim 1, wherein the plurality of dipole antennas, the plurality of patch antennas, and the electrical device are disposed at a same surface of the substrate.

* * * * *